US008465182B1

(12) United States Patent
Davis et al.

(10) Patent No.: US 8,465,182 B1
(45) Date of Patent: Jun. 18, 2013

(54) APPARATUS AND METHOD FOR RETRO-FITTING A RECESSED LIGHT FIXTURE INTO AN EXISTING CEILING MOUNTED ASSEMBLY OR PENETRATION

(75) Inventors: Jared Michael Davis, Newnan, GA (US); Russell Bryant Green, Douglasville, GA (US)

(73) Assignee: Cooper Technologies Company, Houston, TX (US)

( * ) Notice: Subject to any disclaimer, the term of this patent is extended or adjusted under 35 U.S.C. 154(b) by 497 days.

(21) Appl. No.: 12/870,360

(22) Filed: Aug. 27, 2010

(51) Int. Cl.
*F21V 15/00* (2006.01)
*F21V 17/00* (2006.01)

(52) U.S. Cl.
USPC ..... 362/364; 362/365; 362/368; 362/371; 362/396; 248/342; 248/343; 248/344; 411/340

(58) Field of Classification Search
USPC ..... 362/269, 285, 287, 249.02, 364, 362/365, 368, 370, 371, 396; 248/342–344; 411/340; 292/194, 195, 230, 231
See application file for complete search history.

(56) References Cited

U.S. PATENT DOCUMENTS 4,250,540 A * 2/1981 Kristofek ..... 362/368
5,377,088 A 12/1994 Lecluze
5,609,414 A * 3/1997 Caluori ..... 362/366
6,004,011 A * 12/1999 Sieczkowski ..... 362/365
6,343,873 B1 * 2/2002 Eberhard et al. ..... 362/364
6,505,960 B2 * 1/2003 Schubert et al. ..... 362/365
6,554,458 B1 * 4/2003 Benghozi ..... 362/365
7,191,993 B2 * 3/2007 Bobrowski ..... 248/318
7,673,842 B2 * 3/2010 Nevers et al. ..... 248/343
2003/0223240 A1 * 12/2003 Houle ..... 362/364
2005/0258326 A1 * 11/2005 St-Pierre ..... 248/316.7
2009/0284958 A1 11/2009 Pickard et al.

* cited by examiner

*Primary Examiner* — Anh Mai
*Assistant Examiner* — Kevin Quarterman
(74) *Attorney, Agent, or Firm* — King & Spalding LLP

(57) ABSTRACT

A recessed light fixture has a plurality of fasteners for securing a can or top hat of the recessed light fixture to a substrate, e.g., sheetrock ceiling and/or open frame mounting plate. Each of the plurality of fasteners comprise a clevis bracket, a clevis hook having perpendicular tabs that rotatably attach the clevis hook to the clevis bracket. When the recessed light fixture is inserted into an opening of the substrate, the clevis hooks rotate out of the way into slots in a wall of the recessed light fixture can. Once the clevis hooks clear the substrate, the clevis hooks rotate back through the wall of the recessed light fixture can. Then the clevis brackets are slideably moved toward the substrate, whereby gripping portions of the clevis hooks will engage the substrate and thereby hold the recessed light fixture to the substrate.

21 Claims, 4 Drawing Sheets

APPARATUS AND METHOD FOR RETRO-FITTING A RECESSED LIGHT FIXTURE INTO AN EXISTING CEILING MOUNTED ASSEMBLY OR PENETRATION

TECHNICAL FIELD

The present invention relates to recessed light assemblies (fixtures), and more specifically, the invention relates to an apparatus for retro-fitting a new technology recessed light assembly into an existing ceiling penetration and/or open frame mounted plate.

BACKGROUND

Light emitting diode (LED) modules for lighting offer benefits over incandescent and fluorescent lights as sources of illumination. Such benefits include high energy efficiency and longevity. To produce a given output of light, an LED module consumes less electricity than an incandescent or a fluorescent light, and on average, the LED module will last much longer then either the incandescent or fluorescent lights before requiring replacement.

Many millions of incandescent lights, e.g., recessed light fixtures, are in daily use in residential and commercial buildings. In some of these recessed light fixtures the incandescent light bulbs have been replaced with compact fluorescent light (CFL) bulbs, resulting in energy and heat reductions in those fixtures. However, LED lights are more efficient then the CFL bulbs and have much longer operating life. Another concern with using CFL bulbs is proper disposal of the hazardous waste (mercury) contained in the CFL bulbs.

The LED module is very small in comparison to the incandescent and CFL bulbs. However, a lot of heat is generated in this small LED module and must be properly removed and dissipated away from the LED module. Heat removal from the LED module is accomplished with a heat sink assembly in close thermal communication with the LED module. As such, specifically adapted recessed light fixtures for the LED module must be provided. A recessed light fixture having a LED module will integrate the heat sink assembly into a tubular housing (recessed can or "top hat") of the light fixture. The remaining parts of the recessed light fixture are very similar or the same as the older technology incandescent recessed light fixtures, e.g., bar hangers attached to an open frame mounting plate and an electrical junction box. An example of a present technology recessed light fixture is shown in FIGS. 1 and 2 of United States Patent Application Publication No.: US 2009/0284958, incorporated by reference herein for all purposes.

It is important that all luminaires e.g., lighting fixtures, recessed light fixtures, etc., meet UL 1598, latest edition, incorporated by reference herein. In order to meet the requirements of UL 1598, old work existing luminaires, e.g., recessed cans, may necessitate replacement or retrofitting of the existing luminaires. For example, non-airtight recessed light fixtures not rated for direct contact with insulation would have to be replaced or retrofitted, when changing out recessed light fixtures during upgrades for improved building thermal efficiencies. To meet UL 1598 and the latest energy code requirements, a recessed light fixture adapted for direct contact with insulation (IC rated) that is substantially airtight (ICA rated), would be required. An ICA rated recessed light fixture is able to dissipate the heat generated from the light source, e.g., incandescent, CFL or LED module, while covered in insulation material. However, replacement of the energy inefficient recessed light fixtures with ICA rated recessed light fixtures may require a complete removal and new installation of frame and hanger bars compatible with the modern ICA rated recessed can. This can be a major and expensive job to perform.

SUMMARY

The aforementioned deficiencies and needs are addressed, according to the teachings of this disclosure, with a recessed light fixture having fastening assemblies that are adaptable for replacement of existing incandescent bulb recessed light fixtures in a large number of different sizes of recessed light fixture mounting frames, e.g., open mounting frames on hanger bars that are currently installed in residential and commercial buildings. In addition, the recessed light fixture and fastening assemblies thereof, according to the teachings of this disclosure, may be effectively used for new installations of recessed light fixtures (assemblies) in existing ceilings or walls (e.g., remodel).

According to a specific example embodiment of this disclosure, an apparatus for securing a recessed light fixture to a substrate comprises: a plurality of fastening assemblies, each of the plurality of fastening assembles comprising a clevis bracket, and a clevis hook having tabs perpendicular to and at a proximal end thereof, wherein the tabs are rotateably attached to a proximal end of the clevis bracket; a can, the can comprising a tubular shaped wall, a flange attached to a proximal end of the tubular shaped wall and substantially perpendicular thereto, and slots adapted to allow each of a gripping portion of the clevis hooks to pass therethrough; and a fastener for each of the clevis brackets, wherein the fasteners slideably couple the clevis brackets to the tubular shaped wall; wherein when the can passes through an opening in a substrate the clevis hooks are positioned axially to the tubular shaped wall until the clevis hooks clear the substrate, then the gripping portions of the clevis hooks pass through the slots in the tubular shaped wall of the can, and the clevis brackets are slideably positioned along the tubular shaped wall toward the substrate so that the gripping portions of the clevis hooks engage a back face of the substrate while the flange engages a front face of the substrate, thereby holding the recessed light fixture in the substrate.

According to another specific example embodiment of this disclosure, a method for securing a recessed light fixture into a substrate comprises the steps of: inserting a recessed light fixture can having a plurality of fastening assemblies into an opening in a substrate, each of the plurality of fastening assemblies comprises a clevis bracket and a clevis hook, wherein the clevis hook is rotatably attached to a proximal end of the clevis bracket; rotating the clevis hooks to a substantially parallel orientation within a wall of the recessed light fixture can so that the clevis hooks pass through and beyond the opening in the substrate; stopping travel of the recessed light fixture can into the opening in the substrate when a flange attached to a proximal end of the recessed light fixture can that is coterminous with a face of the substrate; moving the clevis brackets slideably toward the substrate until gripping portions of the clevis hooks engage an edge of the opening at the substrate; and locking the clevis brackets to the wall of the recessed light fixture can, thereby holding the recessed light fixture can in the substrate.

BRIEF DESCRIPTION OF THE DRAWINGS

For a more complete understanding of the present invention and the advantages thereof, reference is now made to the following description, in conjunction with the accompanying figures briefly described as follows.

Figure 1A:
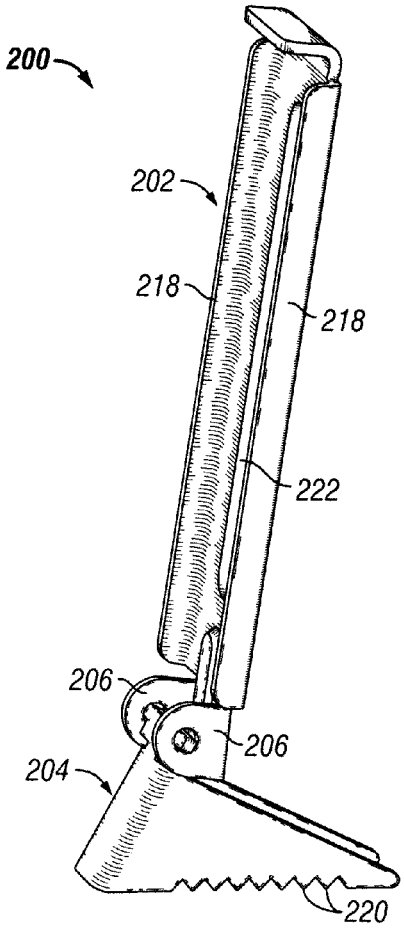
FIGS. 1A and 1B illustrate schematic perspective and front diagrams, respectively, of a fastening assembly for a recessed light fixture, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION OF THE EXEMPLARY EMBODIMENTS

Referring now to the drawings, details of a specific example embodiment of the present invention are schematically illustrated. Like elements in the drawings will be represented by like numbers, and similar elements will be represented by like numbers with a different lower case letter suffix.

Figure 1B:
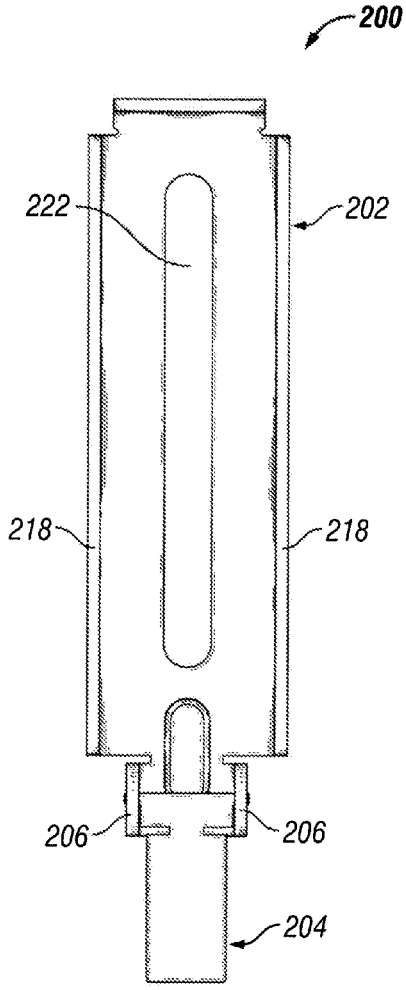

Referring to FIGS. 1A and 1B, depicted are schematic perspective and front diagrams, respectively, of a fastening assembly for a recessed light fixture, according to a specific example embodiment of this disclosure. A fastening assembly, generally represented by the numeral 200, comprises a clevis bracket 202 (top part), a clevis hook 204 (bottom part) having tabs 206 substantially perpendicular to a proximate end of the clevis hook 204. The tabs 206 allow the clevis hook 204 to rotate freely over at least 90 degrees at a pivot point at the proximal end of the clevis bracket 202. Rotation of the clevis hook 204 will be stopped at about 90 degrees perpendicular (rotating up to the right in FIG. 1A) to the long axis of the clevis bracket 202 by the proximal end of the clevis bracket 202 that is located between the tabs 206. An elongated slot 222 in the clevis bracket 202 runs axially with a long dimension thereof. The clevis bracket 202 may also have ridges 218 substantially perpendicular to the face of the clevis bracket 202 for stiffening thereof. The clevis hook 204 has a gripping portion that may also have serrated ridges 220 (e.g., teeth) on its edges that come into contact with an edge of a substrate 112 (see FIG. 2) for improved gripping thereof.

Referring to FIGS. 2A-2D, depicted are schematic perspective diagrams of a recessed light fixture having fastening assemblies shown in various unengaged and engaged positions in a mounting substrate, according to the specific example embodiment of FIG. 1. A plurality of fastening assemblies 200 are placed inside of a recessed light fixture 108 and are attached to inside faces of a wall 114 of the can 108 with a fastener such as a wing nut (not shown) and a bolt 110. Preferably three (3) fastening assemblies 200 may be used for best stability of the recessed light fixture 108 in a substrate 112, and may be spaced apart as appropriate to miss any other features or requirements of the recessed light fixture 108. The fastening assemblies 200 may also be equidistantly spaced apart around the wall circumference of the recessed light fixture 108. The bolt 110 fits inside of the elongated slot 222 in the clevis bracket 202 running axially with the long dimension thereof. The elongated slot 222 allows each of the plurality of clevis brackets 202 to be moveably positioned vertically along the inside face of the wall 114, then locked in place with the fastener (bolt 110 and wing nut (not shown)).

Figure 2B:
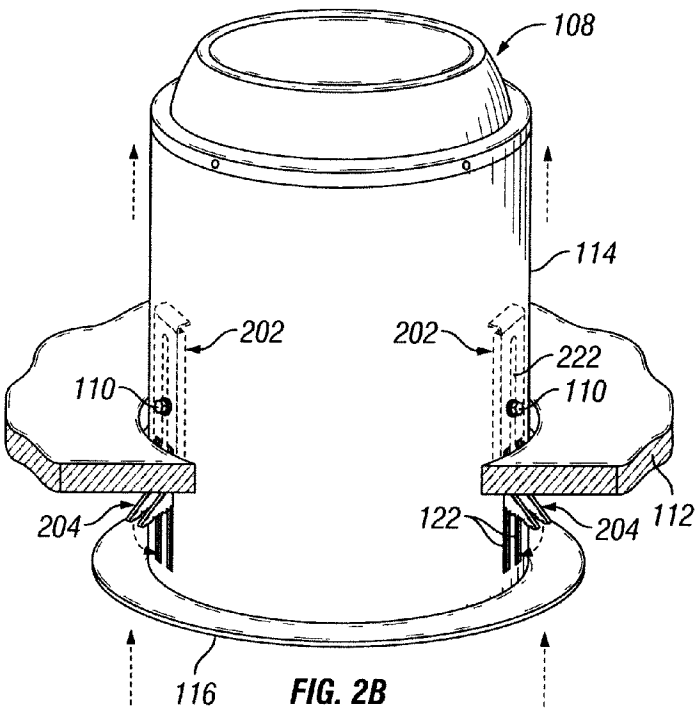
FIGS. 2A-2D illustrate schematic perspective diagrams of a recessed light fixture having fastening assemblies shown in various unengaged and engaged positions in a mounting substrate, according to the specific example embodiment of FIG. 1.
Figure 2A:
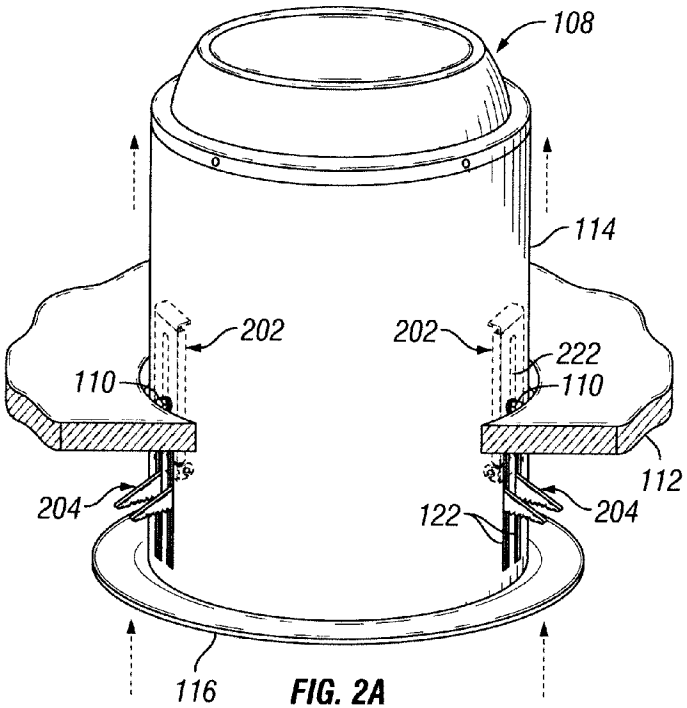
Figure 2D:
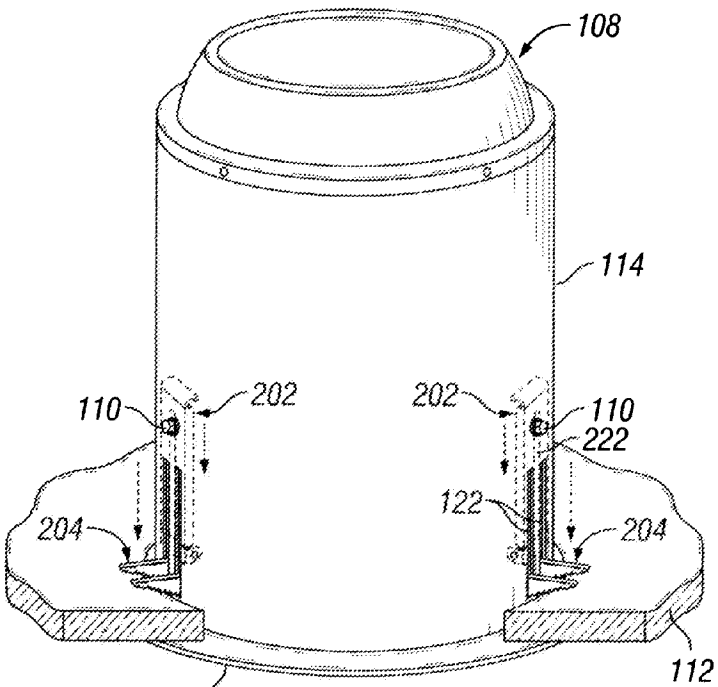
Figure 2C:
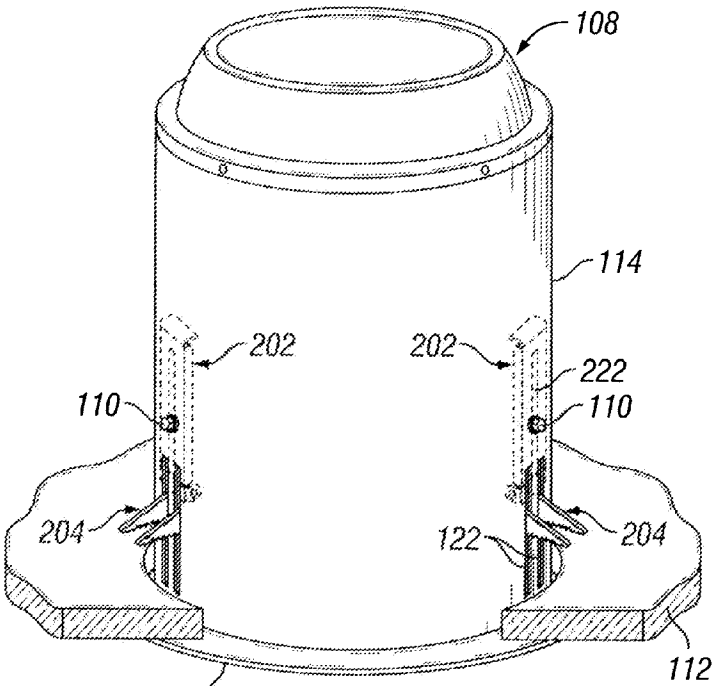

The gripping portions of the clevis hooks 204 swing through respective slots 122 in the wall 114 of the recessed light fixture 108. Initially during insertion of the recessed light fixture 108 into the substrate 112, the clevis hooks 204 are positioned as shown in FIG. 2A, and stay in that position due to gravity. As the recessed light fixture 108 is further inserted into the substrate 112, the gripping portions of the clevis hooks 204 retract into the respective slots 122 as shown in FIG. 2B. The clevis hooks 204 move to substantially vertical positions as they retract into the slots 122 so that the recessed light fixture 108 may easily pass through the opening of the substrate 112. Then when the clevis hooks 204 are past the substrate 112 as shown in FIG. 2C, they revert back to the positions they were in before passing through the opening in the substrate 112. Once a flange 116 of the recessed light fixture 108 comes into contact with the substrate 112, the clevis brackets 202 are pushed toward the substrate 112 and the gripping portions of the clevis hooks 204 thereby come into contact with the edge of the opening in the substrate 112, as shown in FIG. 2D. The flange 116 and the clevis hooks 204 thereby firmly hold the recessed light fixture 108 to the substrate 112. The clevis bracket 202, clevis hook 204 with tabs 206, recessed light fixture 108, and/or wall 114 may be made of metal, e.g., aluminum, steel, an the like.

The recessed light fixture 108 and the plurality of fastening assemblies 200 may be adapted to slide into any number of different sized openings in the substrate 112 (a ceiling having a penetration with an open frame mounting plate above), e.g., recessed light fixture 108 can housings of nominally 5 inch, 7 inch or 8 inch opening diameters. Depending upon the outside diameter of the flange 116 and the length of the gripping portion of the clevis hooks 204 extending from the outside of the wall 114, various opening diameters may easily be accommodated, e.g., opening diameters from about 5 to 6.5 inches or 7 to 8 inches, etc.

Figures 3A, 3B, 3C, 3D:
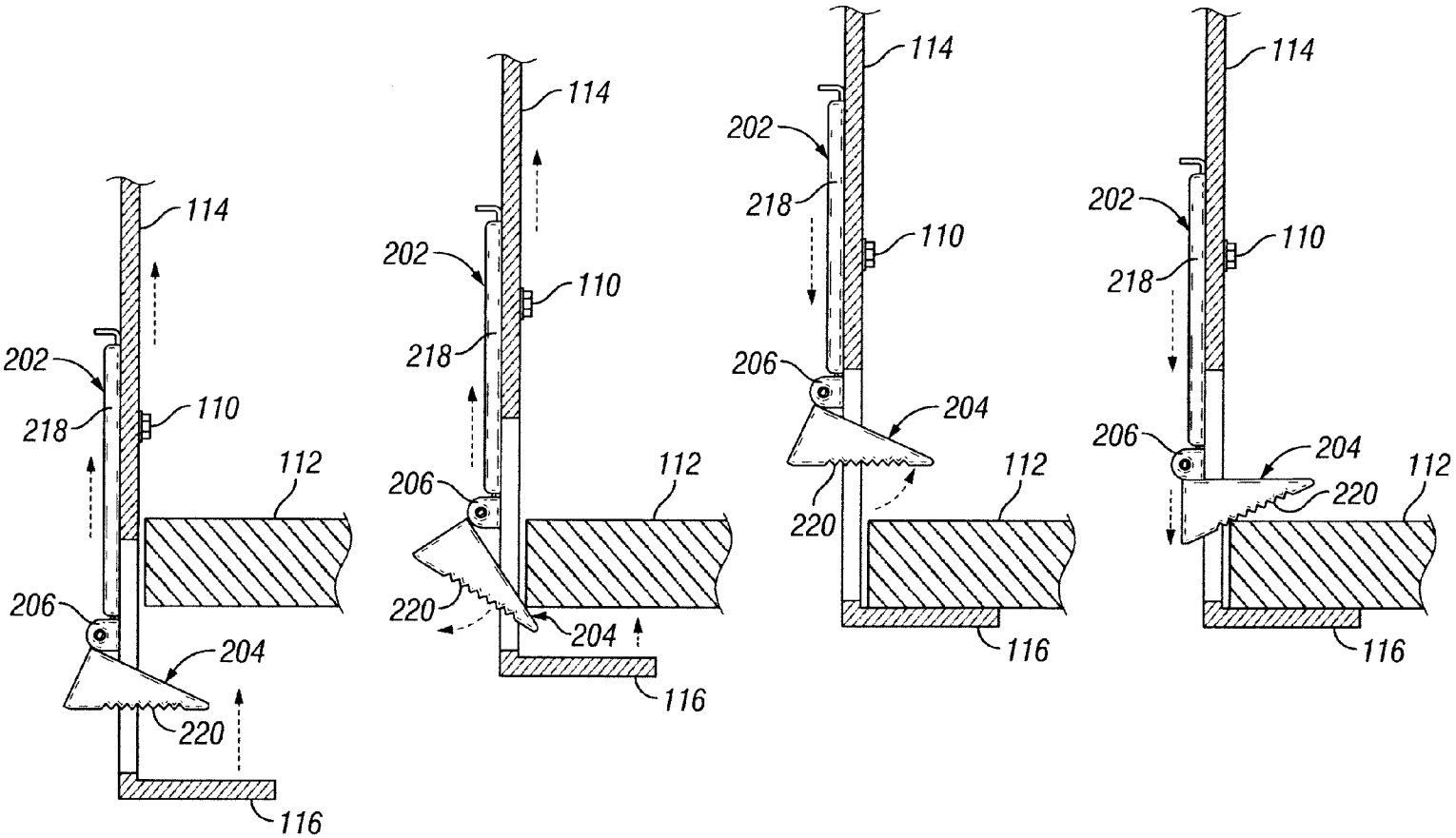
FIGS. 3A-3D illustrate schematic side elevational diagrams of a fastening assembly and side wall of the recessed light fixture shown in FIGS. 1 and 2 in various stages of engagement with the mounting substrate, according to the specific example embodiment of FIG. 1.

Referring to FIGS. 3A-3D, depicted are schematic side elevational diagrams of a fastening assembly and side wall of a recessed can luminaire shown in FIGS. 1 and 2 in various stages of engagement with the mounting substrate, according to the specific example embodiment of FIG. 1. FIG. 3A illustrates the clevis hook 204 in a position determined by gravity as the recessed light fixture 108 is first being inserted into the opening of the substrate 112 (see FIG. 2A). FIG. 3B illustrates the clevis hook 204 coming into contact with an edge of the opening in the substrate 112 (ceiling/open frame mounting plate) as the recessed light fixture 108 is further inserted into the opening of the substrate 112. When the clevis hook 204 contacts the edge of the opening in the substrate 112, it will pivot into the slots 122 in the wall 114 of the recessed light fixture 108, thereby allowing the wall 110 to further pass through the opening in the substrate 112.

The clevis hook 204 rotates around the tab 206 toward a vertical position sufficient to allow passage past the substrate 112. Once the clevis hook 204 is past interference with the substrate 112, it will then move to a certain angle under its own natural weight as shown in FIG. 3C. The recessed light fixture 108 continues into the opening of the substrate 112 until the flange 116 attached to the proximate end of the recessed light fixture 108 comes into contact with a front face of the substrate 112 and can go no further. Now each of the clevis brackets 202 is moved toward the substrate 112 until the clevis hook 204 is in a substantially horizontal position as shown in FIG. 3D. This operation places each of the clevis hooks 204 in contact with an edge of a back face of the opening in the substrate 112. The bolt 110 and wing nut (not shown) for each of the plurality of fastening assemblies 200 are tightened and the recessed light fixture 108 is thereby securely fastened to the substrate 112. The clevis hook 204 is designed so that it remains substantially positioned with respect to the wall 114 as shown in FIG. 3D.

Although specific example embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

We claim:

1. An apparatus for securing a recessed light fixture to a substrate, comprising:

a plurality of fastening assemblies, each of the plurality of fastening assembles comprising a clevis bracket, and a clevis hook having tabs perpendicular to and at a proximal end thereof, wherein the tabs are rotateably attached to a proximal end of the clevis bracket;

a can, the can comprising a tubular shaped wall, a flange attached to a proximal end of the tubular shaped wall and substantially perpendicular thereto, and slots adapted to allow each of a gripping portion of the clevis hooks to pass therethrough; and a fastener for each of the clevis brackets, wherein the fasteners slideably couple the clevis brackets to the tubular shaped wall;

wherein when the can passes through an opening in a substrate the clevis hooks are positioned axially to the tubular shaped wall until the clevis hooks clear the substrate, then the gripping portions of the clevis hooks pass through the slots in the tubular shaped wall of the can, and the clevis brackets are slideably positioned along the tubular shaped wall toward the substrate so that the gripping portions of the clevis hooks engage a back face of the substrate while the flange engages a front face of the substrate, thereby holding the recessed light fixture in the substrate.

2. The apparatus according to claim 1, further comprising ridges on the clevis bracket for resisting bending thereof.

3. The apparatus according to claim 2, wherein the ridges are substantially perpendicular to a face of the clevis bracket for stiffening purposes thereof.

4. The apparatus according to claim 1, wherein the clevis hooks are U-shaped.

5. The apparatus according to claim 1, wherein rotation of the clevis hooks are limited so that clevis hooks remain substantially perpendicular to an external face of the tubular shaped wall upon engaging the substrate.

6. The apparatus according to claim 1, wherein the flange is coterminous with a face of the substrate when the gripping portions of the clevis hooks engage the substrate.

7. The apparatus according to claim 1, wherein the gripping portions of the clevis hooks have serrated ridges thereon.

8. The apparatus according to claim 1, wherein each of the fasteners comprise a bolt and a wing nut.

9. The apparatus according to claim 8, wherein the bolt fits inside of an elongated slot in the clevis bracket.

10. The apparatus according to claim 1, wherein the can is adapted for a light emitting diode (LED) module.

11. The apparatus according to claim 1, wherein the clevis bracket and clevis hook are made of metal.

12. The apparatus according to claim 1, wherein the can is made of metal.

13. The apparatus according to claim 1, wherein the substrate comprises a sheetrock ceiling.

14. The apparatus according to claim 13, wherein the substrate further comprises a an open frame mounting plate at a back face of the sheetrock ceiling.

15. The apparatus according to claim 1, wherein the opening in the substrate is from about five inches to about eight inches in diameter.

16. The apparatus according to claim 1, wherein the plurality of fastening assemblies are three fastening assemblies.

17. The apparatus according to claim 16, wherein the three fastening assemblies are equidistantly spaced apart.

18. The apparatus according to claim 16, wherein the three fastening assemblies are spaced at various distances so as to avoid obstructions.

19. A method for securing a recessed light fixture into a substrate, said method comprising the steps of:

inserting a recessed light fixture can having a plurality of fastening assemblies into an opening in a substrate, each of the plurality of fastening assemblies comprises a clevis bracket and a clevis hook, wherein the clevis hook is rotatably attached to a proximal end of the clevis bracket;

rotating the clevis hooks to a substantially parallel orientation within a wall of the recessed light fixture can so that the clevis hooks pass through and beyond the opening in the substrate;

stopping travel of the recessed light fixture can into the opening in the substrate when a flange attached to a proximal end of the recessed light fixture can that is coterminous with a face of the substrate;

moving the clevis brackets slideably toward the substrate until gripping portions of the clevis hooks engage an edge of the opening at the substrate; and locking the clevis brackets to the wall of the recessed light fixture can, thereby holding the recessed light fixture can in the substrate.

20. The method according to claim 19, wherein the step of moving the clevis brackets slideably toward the substrate include the step of rotating the clevis hooks out through slots in the wall of the recessed light fixture can so that the gripping portions of the clevis hooks will engage the edge of the opening in the substrate.

21. The method according to claim 19, wherein the step of locking the clevis brackets to the wall of the recessed light fixture can comprise the step of tightening bolts and wing nuts to secure the clevis brackets to the wall.

* * * * *